US006483242B1

(12) United States Patent
Benton et al.

(10) Patent No.: US 6,483,242 B1
(45) Date of Patent: Nov. 19, 2002

(54) TRAVELING WAVE TUBE SYSTEM WITH OUTPUT WAVEGUIDE-COUPLER TERMINATION

(75) Inventors: Robert T. Benton, Huntington Beach, CA (US); David S. Komm, Torrance, CA (US)

(73) Assignee: Hughes Electronics Corp., Los Angeles, CA (US)

( * ) Notice: Subject to any disclaimer, the term of this patent is extended or adjusted under 35 U.S.C. 154(b) by 0 days.

(21) Appl. No.: 09/426,666

(22) Filed: Oct. 25, 1999

(51) Int. Cl.[7] ..... H01J 25/34; H01J 23/42
(52) U.S. Cl. ..... 315/3.5; 315/39.3
(58) Field of Search ..... 315/3.5, 39.3

(56) References Cited

U.S. PATENT DOCUMENTS 2,833,955 A * 5/1958 Marchese ..... 315/3.5
2,863,086 A * 12/1958 Cook ..... 315/3.5
2,937,309 A * 5/1960 Lauer ..... 315/3.5
3,309,556 A * 3/1967 Lien ..... 315/3.5
4,851,736 A * 7/1989 Harper et al. ..... 315/3.5
4,985,659 A * 1/1991 Tikes et al. ..... 315/3.5

* cited by examiner

*Primary Examiner*—Benny T. Lee
(74) *Attorney, Agent, or Firm*—John R. Rafter; Terje Gudmestad

(57) ABSTRACT

A traveling wave tube is coupled to an output waveguide by an output coupler. The output coupler includes a single integral hollow termination body having an inner surface and an outer surface. The slow-wave propagation structure of the traveling wave tube is joined to the inner surface of the hollow termination body such that the electron beam of the traveling wave tube passes through the interior of the single integral hollow termination body. The output waveguide contacts the outer surface of the opposite end of the single integral hollow termination body with an interference fit.

13 Claims, 4 Drawing Sheets

TRAVELING WAVE TUBE SYSTEM WITH OUTPUT WAVEGUIDE-COUPLER TERMINATION

BACKGROUND OF THE INVENTION

This invention relates to traveling wave tubes, and, more particularly, to a termination output coupler between an output end of a traveling wave tube and an output device such as a waveguide.

Traveling wave tubes are used to amplify signals in microwave systems. For example, traveling wave tubes may be provided in satellite communications systems to amplify the signals received from earth before their retransmission back to earth.

The traveling wave tube includes an input coupling element, an output coupling element, and a barrel therebetween. The barrel is typically made of a thermally and electrically conductive metal such as annealed copper, although other materials may be used. A metallic helix or other type of slow-wave propagation structure extends through the interior of the barrel and transmits a microwave signal. The metallic slow-wave propagation structure is supported by dielectric rods from the inner wall of the bore of the barrel. The dielectric rods serve to position the metallic slow-wave propagation structure, and also to conduct heat from the metallic slow-wave propagation structure to the barrel, where the heat is dissipated. A properly controlled electron current flowing through the interior passage of the slow-wave propagation structure transfers energy to the microwave signal flowing in the slow-wave propagation structure, thereby amplifying the microwave signal.

In one common application, the output of the traveling wave tube is coupled to an output waveguide. The coupling includes a slow-wave propagation structure sleeve which attaches to the adjacent end of the metallic slow-wave propagation structure, and a second sleeve having a slip fit to the output waveguide. The outer surface of the slow-wave propagation structure sleeve and the inner surface of the second sleeve are slip fitted to each other. By adjusting the exact position of the sleeves, an adequate radio frequency match is obtained between the slow-wave propagation structure and the output waveguide. This coupling approach is operable and is widely used.

The inventors have recognized that the conventional coupling using the slow-wave propagation sleeve structure, while operable, has some drawbacks. There is electrical loss at the two slip joints. Each of the two joints offers thermal resistance to the heat which must be removed by radial outward diffusion to maintain the materials within their safe operating temperature limits. The sleeve-within-a-sleeve configuration limits the interior space available for the electron beam, and increases the likelihood of undesirable electron beam interception before the beam can be collected. This structure is also sensitive to environmental effects such as temperature changes and mechanical forces such as vibration.

There is therefore a need for an improved design to the traveling wave tube system, which improves its efficiency and operation while still allowing an adequate radio frequency match to be realized. The present invention fulfills this need, and further provides related advantages.

SUMMARY OF THE INVENTION

The present invention provides a traveling wave tube system having an output coupler to an output waveguide.

The coupling has allow electrical and thermal loss. It also allows diametral expansion of the electron beam of the traveling wave tube after it leaves the interception region. The thermal and electrical efficiencies of the traveling wave tube system are thereby improved, and the system is capable of handling greater power, as compared with prior coupling approaches. The present coupling is less sensitive to environmental influences, and is more readily fabricated and assembled.

In accordance with the invention, a traveling wave tube system comprises a traveling wave tube, including a hollow barrel, an elongated, hollow slow-wave propagation structure affixed within the barrel and having an interior passage, an electron beam source operable to produce an electron beam within the interior passage of the hollow slow-wave propagation structure, and an input coupler at a first end of the slow-wave propagation structure. The slow-wave propagation structure is preferably a metallic helix. An output waveguide, typically rectangular in cross section, is disposed at a second end of the slow-wave propagation structure. There is an output coupler between the second end of the slow-wave propagation structure and the waveguide. The output coupler comprises a single integral hollow termination body having an inner surface and an outer surface. The slow-wave propagation structure contacts the inner surface of the termination such that the electron beam produced by the electron beam source passes through an interior of the single integral hollow termination body, and the waveguide contacts the outer surface of the single integral hollow termination body, preferably in an interference fit. One or both of the facing surfaces may be coated with gold to improve the electrical and mechanical contact at the facing surfaces. Ordinarily, a set of periodic magnet pole pieces is positioned adjacent to an external surface of the barrel, or some other technique is provided to confine the electron beam.

In the preferred structure, the waveguide includes a stop surface, and the outer surface of the termination body includes a shoulder sized to engage the stop surface. This stop precisely positions the slow-wave propagation structure relative to the waveguide. Desirably, the inner surface of the hollow termination body is substantially circular in cross section, and the diameter of the cross section of the inner surface of the hollow termination body increases with increasing distance from the slow-wave propagation structure. This allows the electron beam to expand radially after it has exited the slow-wave propagation structure.

The present output coupler design requires only a single interface, rather than the two interfaces of the prior art approach, and that single interface has an interference fit rather than a slip fit. These changes reduce the thermal and electrical impedances associated with the coupling, resulting in improved thermal and electrical performance of the system. They also eliminate the possibility of leakage of electromagnetic energy through the slip-fit joints. The traveling wave tube system is therefore able to carry greater power and operate more efficiently. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1A:
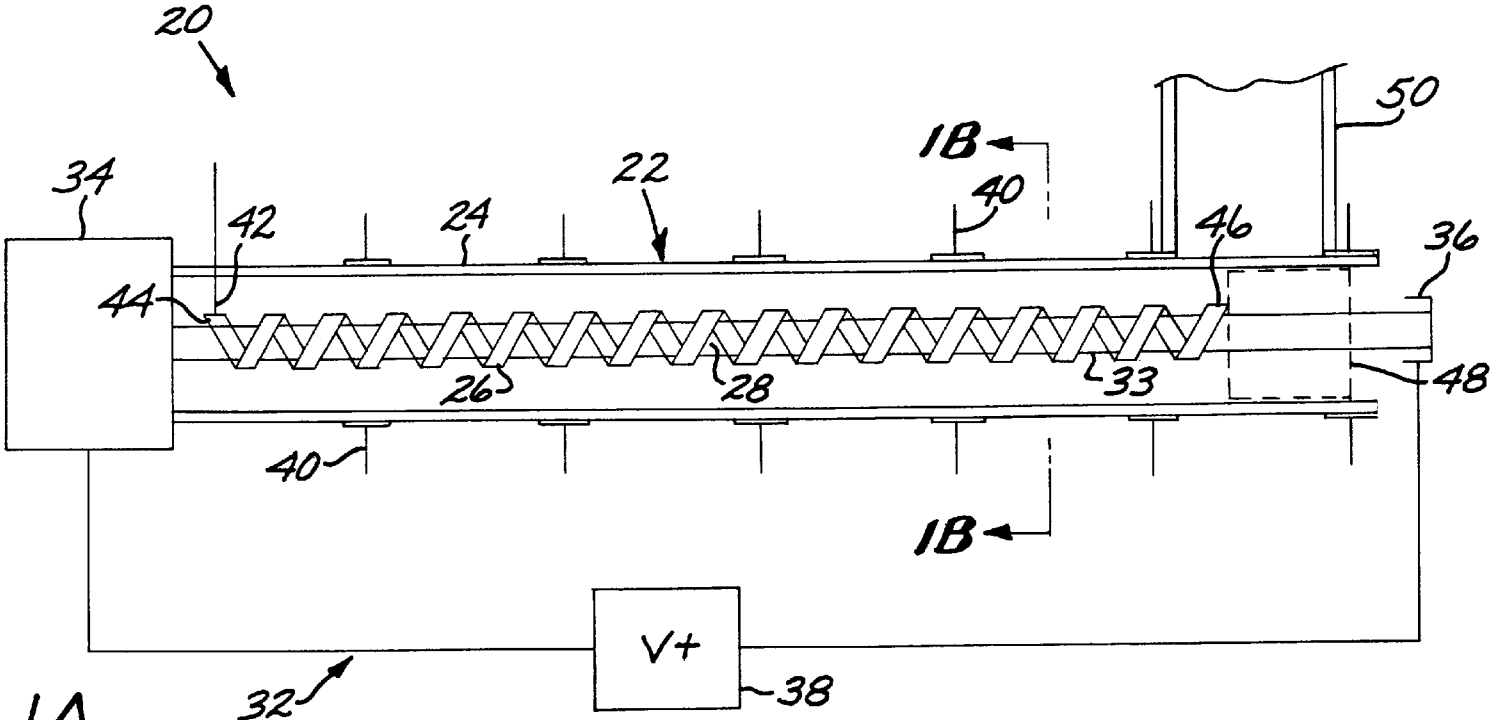
FIG. 1A is a schematic longitudinal illustration of a traveling wave tube system.
Figure 1B:
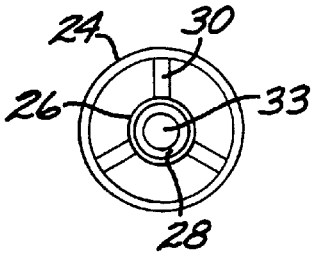
FIG. 1B is a schematic sectional view taken along line 1B—1B.

FIGS. 1A–1B depict the pertinent features of a traveling wave tube system 20. The basic design features of the traveling wave tube system, except as discussed subsequently, have been well known for over 50 years. The following discussion does not attempt to present all of these well known features and details, but instead is limited to those elements which are pertinent to a discussion of the present invention.

Figure 4:
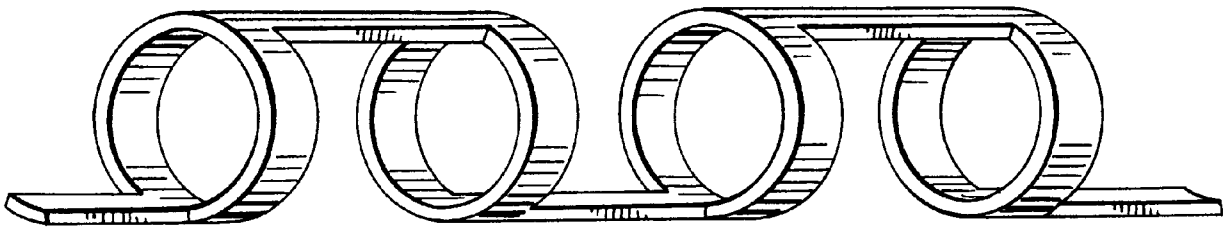
FIG. 4 depicts a ring-bar slow-wave propagation structure.
Figure 5:
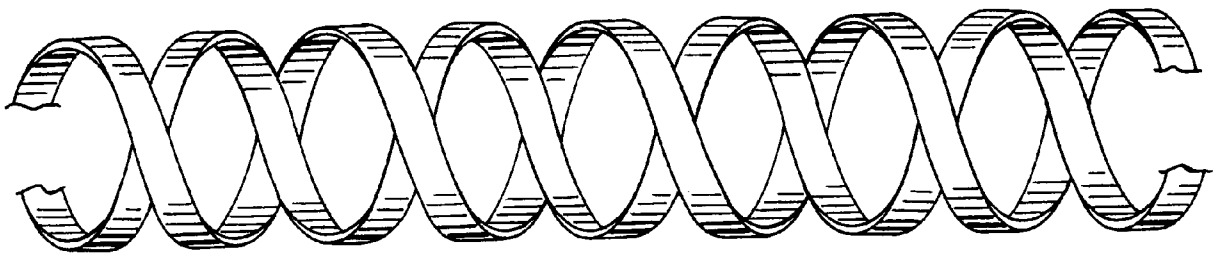
FIG. 5 depicts a contra-wound helix slow-wave propagation structure.

The traveling wave tube system 20 includes a traveling wave tube 22, which comprises an elongated, hollow barrel 24 made of copper, ceramic, or other operable material. An elongated, hollow, slow-wave propagation structure is affixed within the hollow barrel 24. The preferred slow-wave propagation structures such as a ring-bar structure (FIG. 4) or a contra-wound helix (FIG. 5) may be used as well. The helix 26 is preferably made of tungsten of molybdenum, in the form of wire or ribbon. The helix 26 defines an interior passage 28. The helix 26 is typically supported from the inner wall of the barrel 24 by ceramic rods 30, as seen in FIG. 1B.

An electron beam source 32 is disposed and operable to produce an electron beam 33 within the interior passage 28 of the helix 26. The electron beam source 32 typically includes an electron gun 34 at one end of the barrel 24, an electron beam collector 36 at the other end of the barrel 24, and a voltage source 38 to apply a positive voltage (V+) to the electron beam collector 36 relative to the electron gun 34. A set of periodic magnets, whose pole pieces 40 are shown in FIG. 1A, are positioned along the length of the barrel 24 to confine the electron beam 33. A solenoidal magnet surrounding the barrel 24 is often provided in high power traveling wave tube systems, but is omitted from the drawing so as not to obscure the other elements.

A signal, typically a microwave signal, is introduced into the helix 26 by an input coupler 42 at a first end 44 of the helix 26.

An amplified signal is removed from a second end 46 of the helix 26 by an output coupler 48 and transferred to an output waveguide 50, which is typically a rectangular waveguide. The output waveguide may have other operable shapes as well, such as single-ridge or double-ridge configurations.

Figure 3:
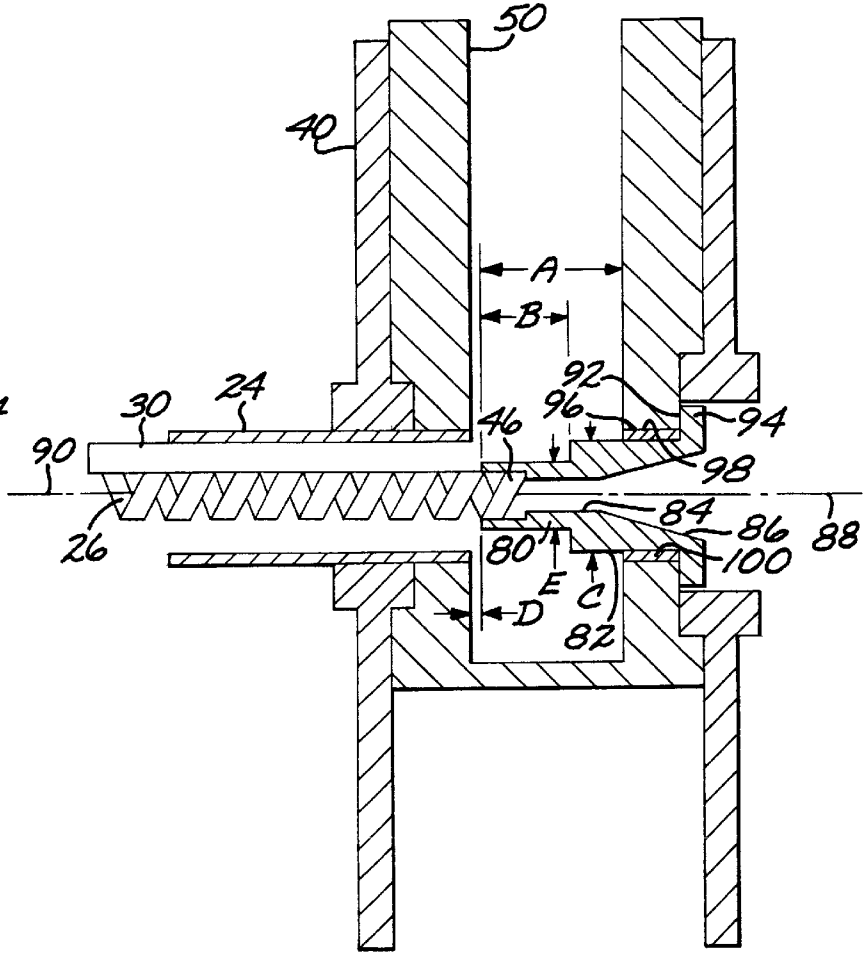
FIG. 3 is a detail of the system of FIG. 1, showing the present approach for an output coupling from the traveling wave tube to the waveguide.
Figure 2:
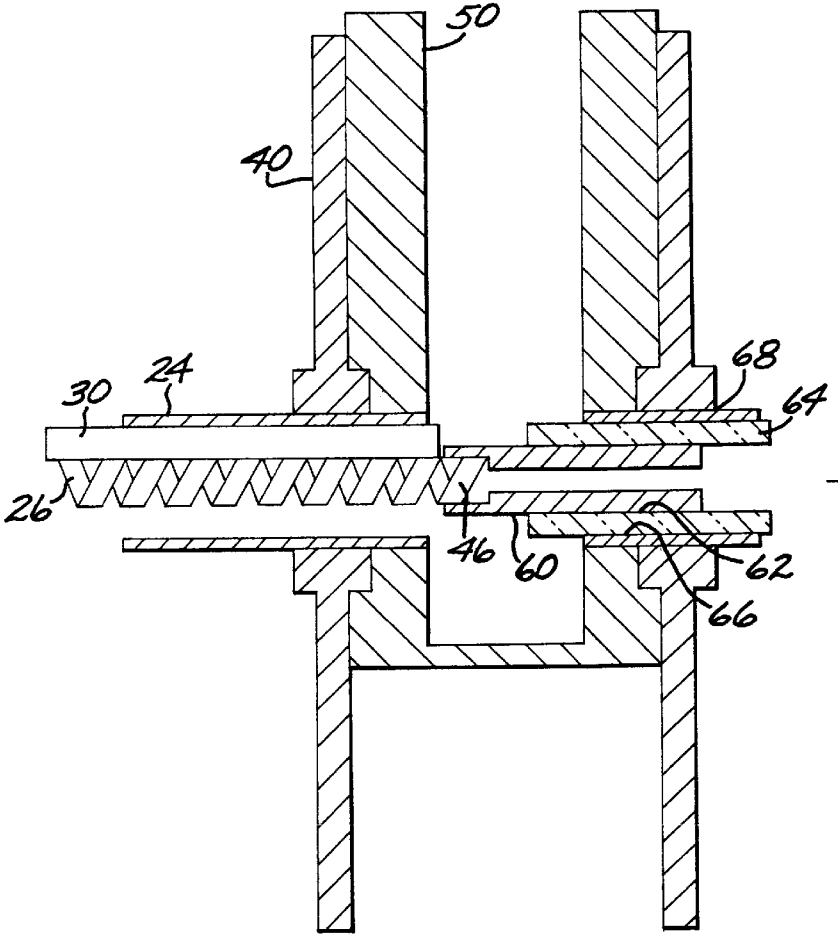
FIG. 2 PRIOR ART
FIG. 2 is a detail of the system of FIG. 1, showing a conventional approach for an output coupling from the traveling wave tube to the waveguide.

The output coupler 48 is shown schematically in FIG. 1A. FIG. 2 illustrates a prior approach to the structure of the output coupler 48, and FIG. 3 illustrates the approach of the present invention to the structure of the output coupler 48. The prior discussion of elements 24, 30, and 40 is incorporated into the description of FIG. 2.

In the prior approach to the output coupler 48, FIG. 2, an internal surface of a hollow helix sleeve 60 is permanently attached to the second end 46 of the helix 26 by brazing or welding. An external surface of the helix sleeve 60 is slip fit at a joint 62 within a bore of a second sleeve 64. The second sleeve 64 is, in turn, slip fit at a joint 66 to a fitting 68 of the output waveguide 50. As may be seen in FIG. 2, this design involves two slip fit joints 62 and 66. The presence of the slip fit joints makes difficult the relative longitudinal positioning of the second end 46 of the helix 26 and the output waveguide 50. The interior space of the helix sleeve 60 through which the electron beam travels is quite small in cross sectional area.

In the past, the movable second sleeve 64 with two slip fits has been required in order to adjust the radio frequency match between the signal on the helix 26 and the output waveguide 50. By adjusting the position of the second sleeve 64 and thus its penetration into the output waveguide 50, the best possible radio frequency match is obtained.

The present approach is shown in FIG. 3. A termination 80 is a single, integral body which serves as the output coupler for the traveling wave tube 22 (see FIG. 1A). That is, there are no sliding interfaces within the body. The termination 80 is preferably made of copper, but may alternatively be made of other metals such as molybdenum. The termination 80 has an outer surface 82, and an inner bore 84 having an inner surface 86. In the preferred embodiment, the termination 80 is rotationally symmetric about a longitudinal axis 88. When the traveling wave tube system 20 according to the invention is assembled, the longitudinal axis 88 coincides with a longitudinal axis 90 of the helix 26.

The cross sectional area (measured in a plane perpendicular to the longitudinal axis 88) of the bore 84 of the termination 80 desirably increases with increasing distance from the second end 46 of the helix 26. For the case of the preferred rotationally symmetric termination 80, the diameter of the bore 84 increases with increasing distance from the second end 46 of the helix 26. This increase in cross sectional area need not be continuous. For example, as shown in FIG. 3, the bore is sufficiently large in diameter to be affixed to the helix 26. There is then a straight portion of constant cross-sectional area, with an enlarging cross-sectional area near the opposite end of the termination 80. The increase in area of the termination allows the electron beam that passes through the interior passage 28 of the helix 26 and through the bore 84 of the termination 80 to expand radially outwardly under space charge effects without being intercepted as body current. The inner diameter of the termination 80 used in the present approach (FIG. 3) may be made larger than the inner diameter of the helix sleeve 60 used in the prior approach (FIG. 2), because of the multiple parts required in the prior approach. The increased inner diameter allows greater lateral expansion of the electron beam without interception, an important feature in some designs.

The waveguide has a stop surface 92 thereon oriented perpendicular to the longitudinal axis 88 of the termination 80. The termination 80 includes a shoulder 94 thereon positioned so that, when the shoulder 94 engages the stop surface 92, the termination 80, and thus the helix 26, are correctly positioned relative to the output waveguide 50. This arrangement aids in achieving proper positioning during assembly of the traveling wave tube system 20 (see FIG. 1A).

A portion of the outer surface 82 of the termination 80 contacts a facing region 96 of the output waveguide 50 in an interference fit 98, such that there is no relative movement of the termination 80 relative to the output waveguide 50 parallel to the axis 88. By contrast, a slip fit at two joints as used in the prior art approach of FIG. 2 allows relative sliding movement parallel to the axis 88 of the sleeve 64 relative to the output waveguide 50.

Preferably in the present approach, that portion of the outer surface 82 which contacts the facing region 96 is coated with a thin layer 100 of gold, typically about 50 microinch thick, or equivalently the facing portion of the facing region 96 may have such a gold layer. (The drawing of FIG. 3 is not to scale in that the layer 100 is shown as thicker than it actually is, so as to be visible in the drawing.) The gold layer 100 promotes a bonding by interdiffusion at the interface between the termination 80 and the facing region 96. The combination of the interference fit 98, the use of only a single interference joint rather than the two slip joints of the prior approach, and the gold layer 100 ensures a close contact at the joint between the termination 80 and the output waveguide 50, reducing electrical losses and improving thermal conductivity at the joint. The improved thermal conductivity allows faster heat removal from the traveling wave tube 22, so that it can operate at a higher temperature and carry more power than otherwise possible.

The exact shape and location of the one-piece termination 80 required for a good radio frequency match is calculated using commercially available electromagnetic simulation software such as BFSS™ software available from Hewlett-Packard or Ansoft, or MAFIA™ software available from AET Associates. The exact shape, dimensions, and location depend upon the specific circumstances. In a case of interest to the inventors involving a 20 GHZ traveling wave tube, the termination 80 had the shape shown in FIG. 3, with dimensions A=0.105 inch, B=0.045 inch, C=0.083 inch, D=0.010 inch, and E=0.049 inch. Because the termination 80 is a single piece, it may be structured to install into the output waveguide 50 with an interference fit and positive stop for superior mechanical and electrical properties.

Figure 7:
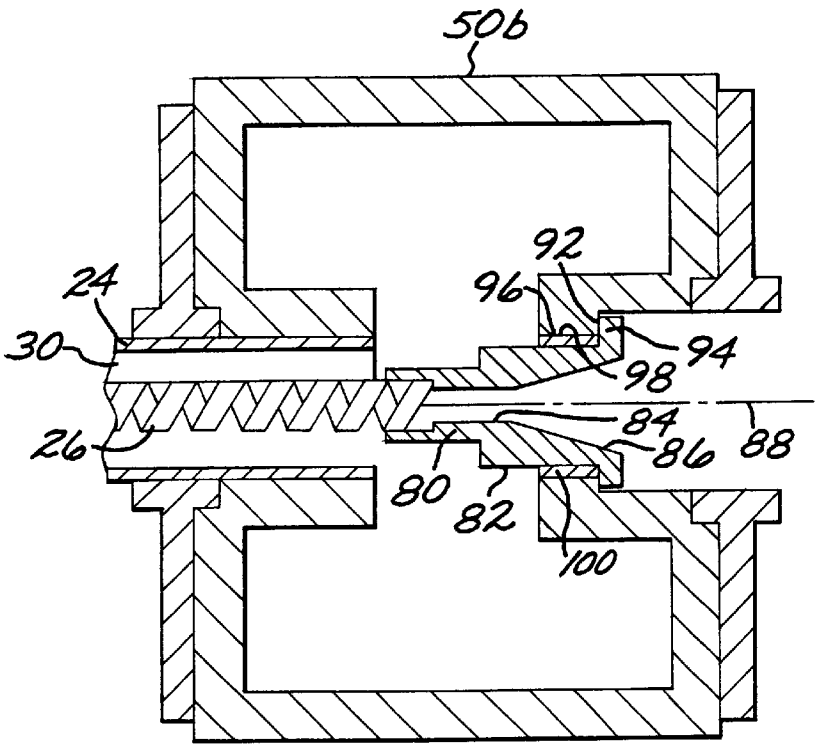
FIG. 7 is a view similar to that of FIG. 3, except that the waveguide has a double-ridge form.
Figure 6:
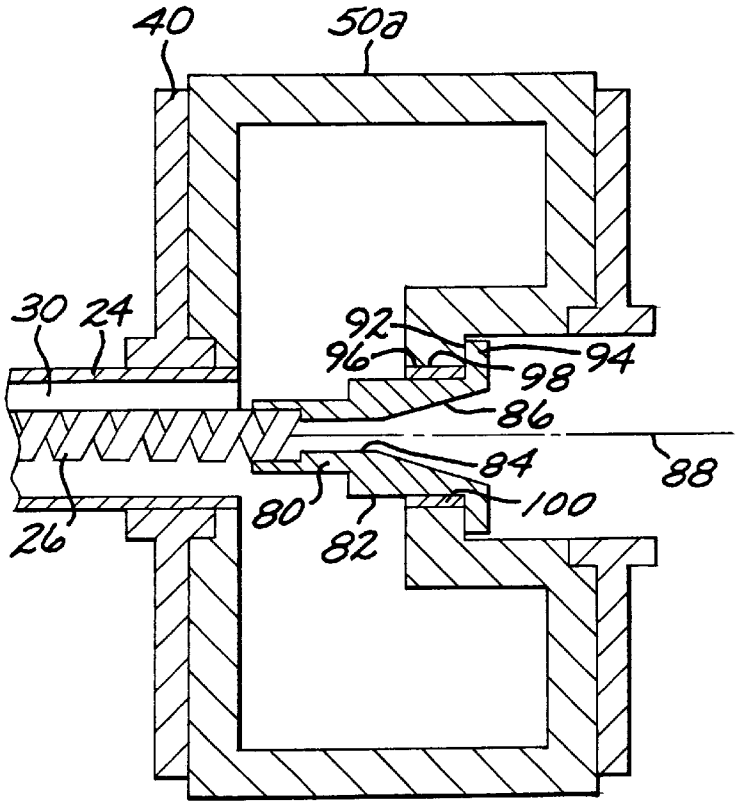
FIG. 6 is a view similar to that of FIG. 3, except that the waveguide has a single-ridge form.

FIG. 3 depicts the termination 80 in use with a rectangular-profile waveguide, but it may be used in relation to other types of waveguides as well. Examples of other operable structures include a single-ridge-profile waveguide 50*a* with termination 80 as shown in FIG. 6, and a double-ridge-profile waveguide 50*b* with termination 80 as shown in FIG. 7. The prior description of all other identified elements is incorporated into the descriptions of FIGS. 6 and 7.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A traveling wave tube system, comprising:

a traveling wave tube, including a hollow barrel, an elongated, hollow slow-wave propagation structure affixed within the barrel and having an interior passage, an electron beam source operable to produce an electron beam within the interior passage of the hollow slow-wave propagation structure, and an input coupler at a first end of the slow-wave propagation structure;

an output waveguide disposed at a second end of the slow-wave propagation structure; and an output coupler between the second end of the slow-wave propagation structure and the output waveguide, the output coupler being a single integral hollow termination body having an inner surface defining a bore through the output coupler and an outer surface, the slow-wave propagation structure being received within the bore so that an outer surface of the slow-wave propagation structure contacts the inner surface of the hollow termination body such that the electron beam produced by the electron beam source passes through an interior of the single integral hollow termination body, and the output waveguide contacting the outer surface of the single integral hollow termination body.

2. The traveling wave tube system of claim 1, wherein the output waveguide includes a stop surface, and the outer surface of the termination body includes a shoulder sized to engage the stop surface.

3. The traveling wave tube system of claim 1, wherein the output waveguide contacts the outer surface of the termination body in an interference fit.

4. The traveling wave tube system of claim 1, wherein the inner surface of the hollow termination body is substantially circular in cross section, and wherein the diameter of the cross section of the inner surface of the hollow termination body increases with increasing distance from the slow-wave propagation structure.

5. The traveling wave tube system of claim 1, wherein the slow-wave propagation structure is selected from the group consisting of a helix, a ring-bar structure, and a contra-wound helix.

6. The traveling wave tube system of claim 1, wherein the output waveguide has a cross sectional shape selected from the group consisting of a rectangle, a single-ridge profile, and a double-ridge profile.

7. The traveling wave tube system of claim 1, wherein a portion of the outer surface of the termination body that contacts the output waveguide is coated with a layer of gold.

8. The traveling wave tube system of claim 1, further including a set of periodic magnet pole pieces positioned adjacent to an external surface of the barrel.

9. A traveling wave tube system, comprising:

a traveling wave tube, including a hollow barrel, a metallic helix affixed within the barrel and having an interior passage, an electron beam source operable to produce an electron beam within the interior passage of the helix, and an input coupler at a first end of the helix;

an output waveguide disposed at a second end of the slow-wave propagation structure, the output waveguide having a stop surface thereon; and an output coupler between the second end of the helix and the output waveguide, the output coupler comprising a single integral hollow termination body having an inner surface and an outer surface, the outer surface including a shoulder sized to engage the stop surface of the output waveguide, a helix joint between the inner surface of the hollow termination body at a first end of the hollow termination body, and the helix, and an interference joint between the outer surface of the hollow termination body at a second end of the hollow termination body and a receiver surface of the output waveguide.

10. The traveling wave tube system of claim 9, wherein the inner surface of the hollow termination body is substantially circular in cross section, and wherein the diameter of the cross section of the inner surface of the hollow termination body increases with increasing distance from the helix.

11. The traveling wave tube system of claim 9, wherein the output waveguide has a cross sectional shape selected from the group consisting of a rectangle, a single-ridge profile, and a double-ridge profile.

12. The traveling wave tube system of claim 9, wherein a portion of the outer surface of the termination body that forms the interference joint is coated with a layer of gold.

13. The traveling wave tube system of claim 9, further including a set of periodic magnet pole pieces positioned adjacent to an external surface of the barrel.

* * * * *